US008046943B2

(12) United States Patent
Kay

(10) Patent No.: US 8,046,943 B2
(45) Date of Patent: Nov. 1, 2011

(54) SAFETY KICK PLATE DEVICE AND MANUFACTURING METHODS

(76) Inventor: Ronald J. Kay, Barrington, IL (US)

( * ) Notice: Subject to any disclaimer, the term of this patent is extended or adjusted under 35 U.S.C. 154(b) by 0 days.

(21) Appl. No.: 12/624,341

(22) Filed: Nov. 23, 2009

(65) Prior Publication Data

US 2011/0119972 A1 May 26, 2011

(51) Int. Cl.
*G09F 13/06* (2006.01)

(52) U.S. Cl. ..... 40/580; 40/615

(58) Field of Classification Search ..... 40/570, 40/552, 542, 550, 551, 579, 580; 362/456
See application file for complete search history.

(56) References Cited

U.S. PATENT DOCUMENTS

| | | | | |
|---|---|---|---|---|
| 4,401,050 | A * | 8/1983 | Britt et al. | 116/205 |
| 5,685,098 | A * | 11/1997 | Wegrzyn | 40/570 |
| 6,276,634 | B1 * | 8/2001 | Bodle | 244/118.5 |
| 6,785,992 | B2 * | 9/2004 | Chiarucci | 40/596 |
| 6,932,486 | B1 * | 8/2005 | Eller et al. | 362/100 |
| 7,241,021 | B2 * | 7/2007 | Hannington | 362/84 |
| 2003/0182833 | A1 * | 10/2003 | Lewis | 40/551 |
| 2005/0198879 | A1 * | 9/2005 | Hannington | 40/570 |
| 2007/0236941 | A1 * | 10/2007 | Logan et al. | 362/347 |
| 2008/0263923 | A1 * | 10/2008 | Kim | 40/550 |
| 2009/0145059 | A1 * | 6/2009 | Kay | 52/179 |
| 2010/0018092 | A1 * | 1/2010 | Peckham | 40/542 |

* cited by examiner

*Primary Examiner* — Joanne Silbermann
*Assistant Examiner* — Kristina Staley
(74) *Attorney, Agent, or Firm* — Valauskas Corder LLC

(57) ABSTRACT

A safety kick plate device and improved manufacturing thereof, wherein the safety kick plate device includes a base component including a communication element through which a light emission component is visible. A communication protection element provides reinforcement and strength to the communication element as well as mitigates damage to the light emission component.

9 Claims, 6 Drawing Sheets

SAFETY KICK PLATE DEVICE AND MANUFACTURING METHODS

FIELD OF THE INVENTION

The present invention relates generally to safety devices and more particularly to a safety indicator apparatus for architectural structures, specifically kick plate devices for doors and stairs, and improved manufacturing thereof.

BACKGROUND OF THE INVENTION

Safety devices are used on architectural structures in a variety of environments to reduce risk. Many environments exist where various poor lighting scenarios occur, for example, dimmed lighting or darkness due to a power failure or smoke resultant from a fire. Risks may occur when people attempt to navigate in poorly lit environments; such risks include physical injury, lack of orientation, lack of information regarding navigation, and lack of familiarity with the environment.

Recently, laws, ordinances, codes, and/or regulations have been implemented that require certain safety signage in public gathering places—both new and existing structures—and include, for example, safety signage in egress pathways to communicate exits from the environment. Examples of public gathering places include, for example, high rise buildings, hotels, dormitories, arenas, stadiums, hospitals, underground environments such as parking structures and subways, prisons, and institutions to name a few. Although, even where signage is not required, certain circumstances may necessitate signage, for example, to indicate an unexpected stair on private property.

The prior art devices that are currently available are deficient in several respects including limitations in design and manufacturability. For example, U.S. Pat. No. 6,843,010 discloses a sign that requires light actuated by electricity. This presents the disadvantage of routing electrical wiring, which may not be feasible in certain environments. Further, because the sign requires electricity, the sign may not work when the power goes out such as in a blackout.

United States Patent Application Publication No. US 2007/0137077 discloses a sign that includes a photo-luminescent material, but also includes a lighting source of a plurality of light emitting diodes for charging the photo-luminescent material. Like that mentioned above, an electrical source is required.

While the prior art devices fulfill their respective particular objectives and requirements, the need still remains for safety devices and manufacturing methods thereof that fulfill the deficiencies of the prior art devices and provide additional functionality. The present invention satisfies this need.

SUMMARY OF THE INVENTION

The present invention relates generally to safety devices and more particularly to a safety indicator apparatus for architectural structures, specifically kick plate devices for doors and stairs. The devices of the present invention do not require an electrical source to power the safety device. Additionally, embodiments of the present invention contemplate improved manufacturing thereof such as two-step and three-step manufacturing processes.

The improved safety kick plate device and methods of the present invention fulfill the deficiencies in design, manufacturability, and functionality of prior art devices. The present invention includes improved material compositions and material requirements. Additionally, the present invention is flexible in design thereby reducing cost and time associated with manufacturing.

For purposes of this application, an architectural structure is any physical formation. Although the present invention is discussed herein with respect to doors and stairs, any architectural structure is contemplated such as floors, walls, ceilings, piers, decks, balconies, hallways, bridges, wharfs, landings, platforms, fences, ladders, escalators, elevators, parking lots, boats, ships, planes, automobiles, and arenas just to name a few.

The safety kick plate device of the present invention may be attached to an architectural structure of any construction, such as wood, composite wood, cement, fiberglass, plastic, metal, concrete, steel, stone, brick, glass, asphalt, and carpet to name a few. The safety kick plate device may be portable or permanently secured to an architectural structure such as by using hardware including screws or nails, adhesive including liquid or tape, or Velcro®. In one embodiment, the safety kick plate device includes a connection component that not only secures the safety kick plate device to an architectural structure, but also joins the components of the safety kick plate device improving the manufacturing thereof.

In one embodiment, the safety kick plate device according to the present invention includes a base component, a light emission component, and a connection component.

The base component, in one embodiment, includes a front surface, back surface, outside edge, and one or more inside edges. It is contemplated that the outside edge of the base component may include a bevel feature, for example, to prevent shoes or feet from catching on the safety kick plate device. According to the present invention, the base component may be any length, height, depth, shape, or size. For example, in one embodiment, the base component may be about and including 3 feet in length and about and including 1 foot in height. As an example of another embodiment, the base component may be about and including 2½ feet in length and about and including 6 inches in height. In another embodiment, the base component may be circular in shape.

The base component includes a cavity element positioned on the back surface. The cavity element comprises a boundary element that defines a recessed surface. The cavity element may be of any length, height, depth, shape, and size, for example, the cavity element may be about and including ⅛ inch to about and including 1/32 inch in depth measured from the back surface of the base component.

A light emission component is received by the cavity element. The light emission component includes a top face, bottom face, and a border element. Once received by the cavity element, the top face of the light emission component substantially abuts the recessed surface of the cavity element. The light emission component is any length, width, depth, shape, and size for positioning within the cavity element of the base component. The light emission component stores energy, for example, as by absorbing photons and releasing the energy as light over a duration of time. The light emission component is capable of producing a sustained visible glow including in darkness such as at a minimum of one hour or longer. According to the present invention, the light emission component is a material with a fluorescent or photoluminescent quality, for example, strontium oxide, strontium aluminate, strontium silicate with magnesium or metal sulfides such as calcium sulfide, strontium sulfide, zinc sulfide, and cadmium sulfide, or any combination thereof. The light emission element may further be a metal or polymer.

As mentioned above, the base component includes one or more inside edges. The one or more inside edges form a communication element. The communication element appears as a "cut-out" from the base component such that the light emission component is visible from the front surface of the base component. A communication element is anything that conveys information and includes, for example, one or more letters, numbers, symbols, or any combinations thereof.

In another embodiment, the base component includes a communication protection element raised from the front surface. The communication protection element includes an inward side, upper side and outward side. The inward side of the communication protection element substantially abuts and extends from the one or more inside edges of the base component. The inward side of the communication protection element continues to the upper side and to the outward side, wherein the outward side meets the front surface of the base component.

The communication protection element provides reinforcement and strength to the communication element. The communication protection element assists to alleviate breaking or cracking of the base component upon contact particularly at narrow cross-sectional areas, for example, inadvertent contact by a shoe. Additionally, the communication protection element mitigates damage to the light emission component. The communication protection element provides an elevated surface protecting the communication element so that any contact near the light emission component is first received by the communication protection element and thereby redirected to the front surface of the base component.

In another embodiment, the front surface of the base component includes a texture element. The texture element may assist in matching the texture of the material from which the architectural structure is constructed, onto which the safety kick plate device is installed. Additionally, the texture element may alleviate the visibility of dirt, scuffs, and scrapes.

A connection component joins the base component and the light emission component. For purposes of this application, the term connection component contemplates overmolding, heat stake, weld, snap fit such as annular snap fit or cantilever snap fit, adhesive, adhesive tape, fasteners, chemical bonding, mechanical fit, or interference fit. For purposes of this application, the term "weld" includes sonic weld, vibration weld, orbital weld, ultrasonic weld, frictional weld, spin weld, radio frequency weld, and laser weld, to name a few. In one embodiment, the connection component includes a first securement side and a second securement side. The first securement side joins the base component and the light emission component and the second securement side joins the safety kick plate device to an architectural structure. One example of a connection component is double-sided adhesive.

In certain embodiments, the safety kick plate device includes a removable backing liner covering a side of the connection component. The backing liner is removed immediately prior to installation, revealing the adhesive.

The base component and light emission component of the present invention are made of any material that can be molded or extruded, for example, metal such as aluminum or powdered metals, composite lumber, and polymers, thermoset or thermoplastic resins. Polymers include plastics such as thermoplastic, thermoset plastic, polyurethane, polyethylene, polypropylene, nylon and other engineered materials. The present invention may also be manufactured using recycled post-consumer materials such as nylon, nylon alloys, polypropylene, other recycled plastics, or any combination thereof. The materials may further be compounded with a glass fiber or powdered metal to maintain rigidity such that the components do not warp or twist during manufacturing or installation.

The material used for the safety kick plate device is easily cut, for example on a table saw or miter saw, to form the communication element. It is also contemplated that the communication element may be formed during the manufacturing process such as during an injection molded process.

It is further contemplated that the material may be cured by a radiation source such as ultraviolet ("UV") light or contain a UV additive in the material. Additionally, the material may be impact modified to improve the material properties such as wear, non-slip, and weatherability, for example 2000 kilojewels of weatherability. The material may also be compounded with a flame retardant additive to meet certain fire codes and regulations.

The materials used to manufacture the base component of the present invention may further be compounded with any color concentrate. This contemplates color matching to the architectural structure, for example, color matching stain, paint, or composite lumber color of the architectural structure. The base component may be manufactured with any color concentrate, including those that emit light—such as that used for the light emission component—so that that the entire safety kick plate device illuminates.

The present invention may be manufactured by one or more of the following: extrusion, injection molding, insert injection molding, or two-shot molding process.

It is also contemplated that the texture element of the present invention may be created by a calendering process during an extrusion process. A texture element includes, for example, cleats, ridges, tread, or grooves, to form a non-slip surface. It is further contemplated that the components of the present invention can include a texture element created by a laser etched detail during injection molding, insert injection molding, or two-shot molding.

There are various manufacturing methods contemplated. As one example, the base component and light emission component are individually injection molded. In another example, the base component is injection molded and the light emission component is extruded. The elements are then joined by the connection component.

An object of the present invention is to provide a safety kick plate device that complies with all current and future contemplated industry standards and specifications, including Property Services Agency ("PSA"), International Building Code ("IBC"), National Fire Protection Association ("NFPA"), International Code Compliance ("ICC"), American National Standards Institute ("ANSI"), International Residential Code ("IRC"), and American with Disabilities Act ("ADA"). As an example, the present invention is contemplated to comply with 2009 building codes as identified under ASTM E2030-07, E2072-04, and E2073-07.

Another object of the present invention is to qualify for credits such as tax credits or energy credits, for example, credits awarded for the consumption of little or no energy or credits awarded for the use of recycled material in the manufacturing the safety kick plate device.

Yet another object of the present invention is to reduce risks that may occur when people attempt to navigate in poorly lit environments. The present invention provides components that function as a safety egress or ingress pathway to quickly evacuate people in the case of an emergency.

Another object of the present invention is to provide components that serve additional functions such as an illumination guide.

Yet another object of the present invention is to provide a safety kick plate device that requires little to no maintenance.

Yet another object of the present invention is to provide a light emission component that does not lift or peel away from the base component.

Another object of the present invention is to secure the safety kick plate device to any architectural structure regardless of composition, e.g., such as wood, composite wood, cement, fiberglass, metal, concrete, steel, stone, brick, glass, asphalt, and carpet.

The present invention and its attributes and advantages will be further understood and appreciated with reference to the detailed description below of presently contemplated embodiments, taken in conjunction with the accompanying drawings and the claims.

DESCRIPTION OF THE DRAWINGS

The invention can be better understood by reading the following detailed description of certain preferred embodiments, reference being made to the accompanying drawings in which.

DETAILED DESCRIPTION OF THE INVENTION

Figure 1:
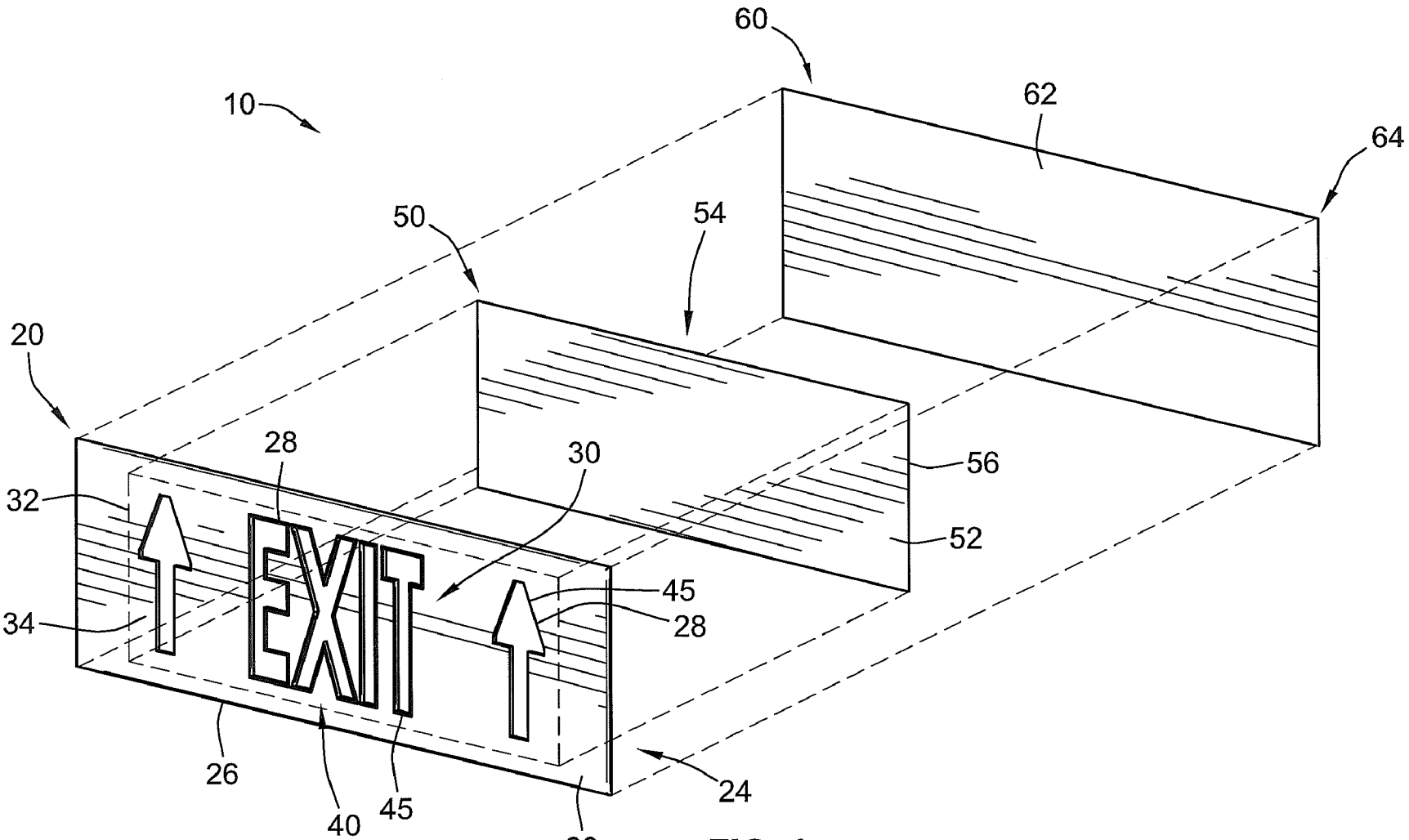
FIG. 1 shows an exploded view of one embodiment according to the present invention.

FIG. 1 shows an exploded view of one embodiment according to the present invention. As shown in FIG. 1, the safety kick plate device 10 includes a base component 20, a light emission component 50, and a connection component 60. The base component 20 includes a front surface 22, back surface 24, and outside edge 26 and one or more inside edges 28. The base component 20 includes a cavity element 30 positioned on the back surface 24. The cavity element 30 includes a boundary element 32 that defines a recessed surface 34.

Figure 5:
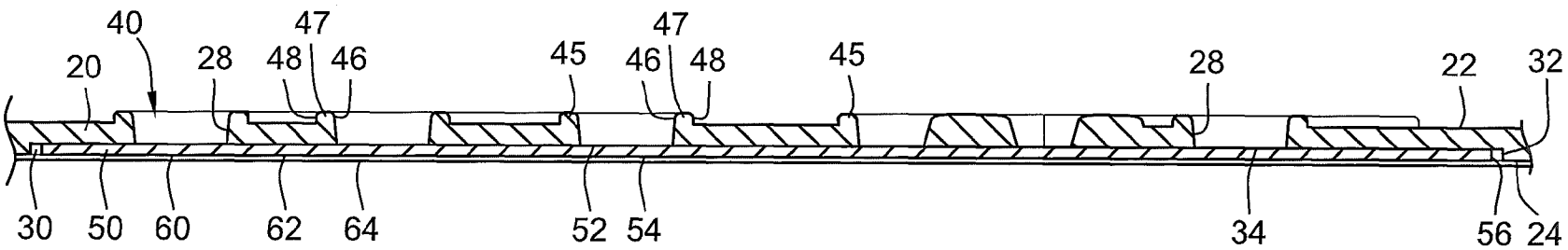
FIG. 5 shows a partial magnified view of the cross sectional view shown in FIG. 4 according to the present invention.
Figure 7:
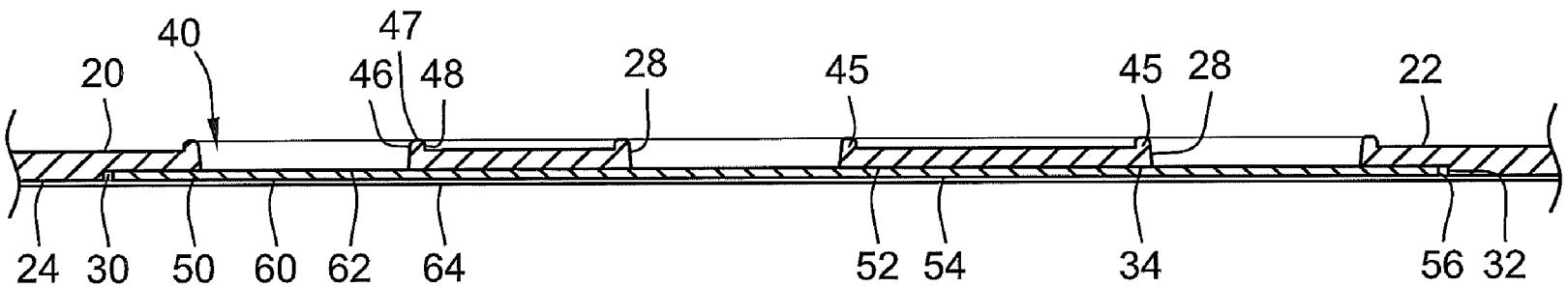
FIG. 7 shows a partial magnified view of the cross sectional view shown in FIG. 6 according to the present invention.

The one or more inside edges 28 form a communication element 40. The front surface 22 of the base component 20 further includes a communication protection element 45, which substantially abuts and extends from the one or more inside edges 28. The communication protection element 45 protrudes from the front surface 22 and includes an inward side 46, upper side 47, and outward side 48 as shown in FIG. 5 and FIG. 7.

A light emission component 50 includes a top face 52, bottom face 54, and border element 56. The light emission component 50 is received within the cavity element 30 such that the top face 52 of the light emission component 50 substantially abuts the recessed surface 34 of the cavity element 30.

The embodiment of the connection component 60 as shown in FIG. 1 includes a first securement side 62 and a second securement side 64. The connection component 60 joins the base component 20 and the light emission component 50. More specifically, the first securement side 62 is positioned on the bottom face 54 of the light emission component 50 and the back surface 24 of the base component 20. In certain embodiments, the second securement side 64 may include a removable backing liner (not shown) covering the second securement side 64. The backing liner is removed from the connection component 60 to expose an adhesive substance on the second securement side 64 in order to install the safety kick plate device 10 to an architectural structure.

In one embodiment, the adhesive substance is a pressure sensitive adhesive substance with attachment strength sufficient to securely hold the safety kick plate device 10 onto an architectural structure.

Light from a light source of the surrounding environment is absorbed and remitted by the light emission component 50, more specifically, traveling through the communication element 40 of the base component 20. In the preferred embodiment the absorption of light by the light emission component 50 occurs quickly whereas the remission occurs slowly over an extended period of time. As a result, the light emission component 50 continues to emit light, or glow, even after the light source has been removed. The light emission component is contrasted with the base component 20 thereby making it possible for the communication element 40 to be recognized.

Figure 2:
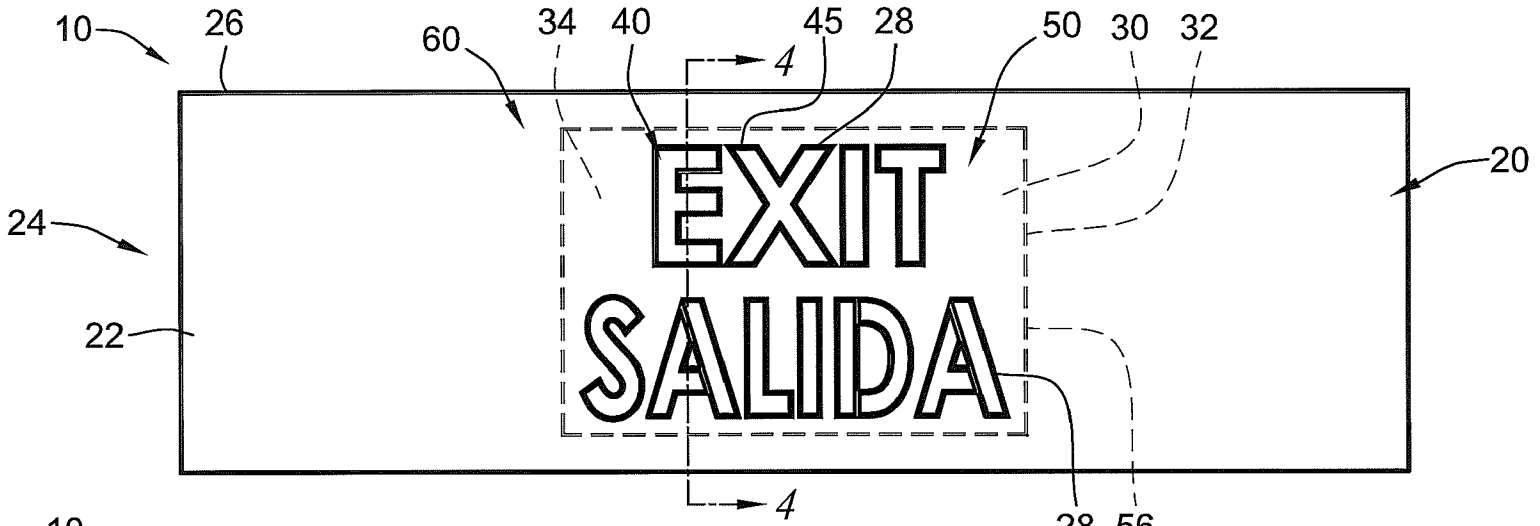
FIG. 2 shows a front view of one embodiment according to the present invention.
Figure 3:
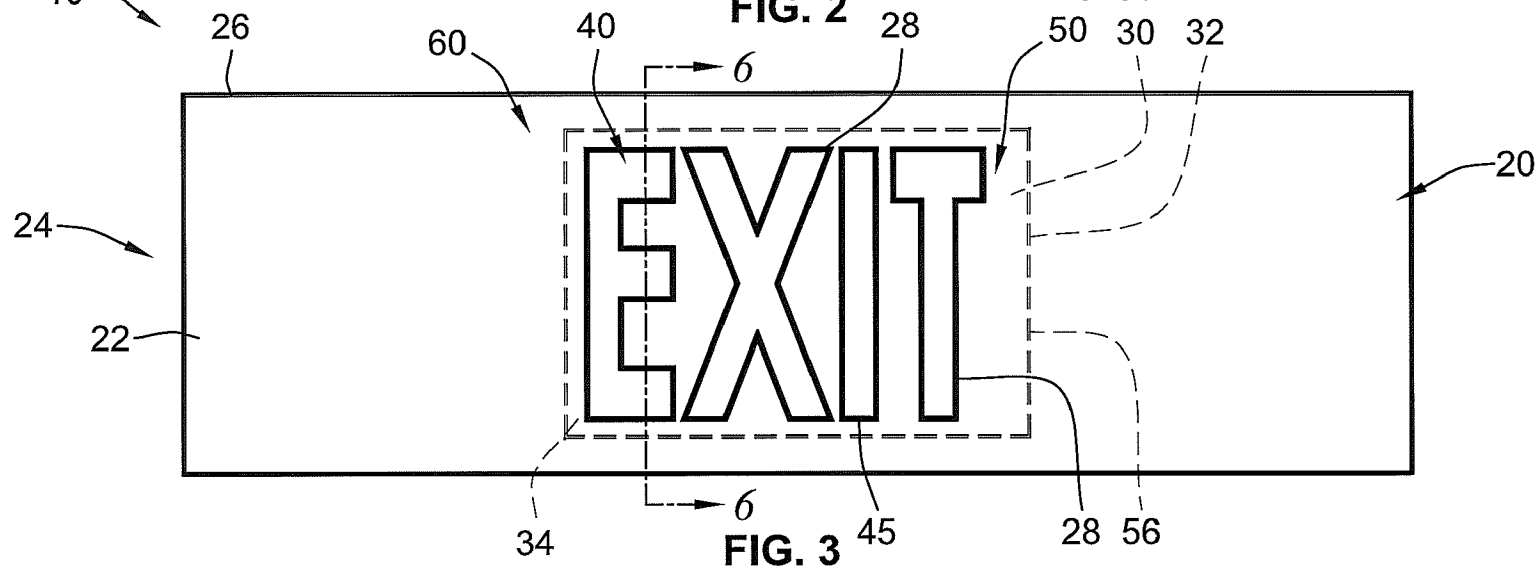
FIG. 3 shows a front view of another embodiment according to the present invention.

FIG. 2 and FIG. 3 show front views of various embodiments according to the present invention. As shown in FIG. 2, the communication element 40 forms "EXIT SALIDA". As shown in FIG. 3, the communication element 40 forms "EXIT". The communication element 40 may be formed within the base component 20 such as stencil-stamped, cut or formed during an injection molded process.

Figure 4:
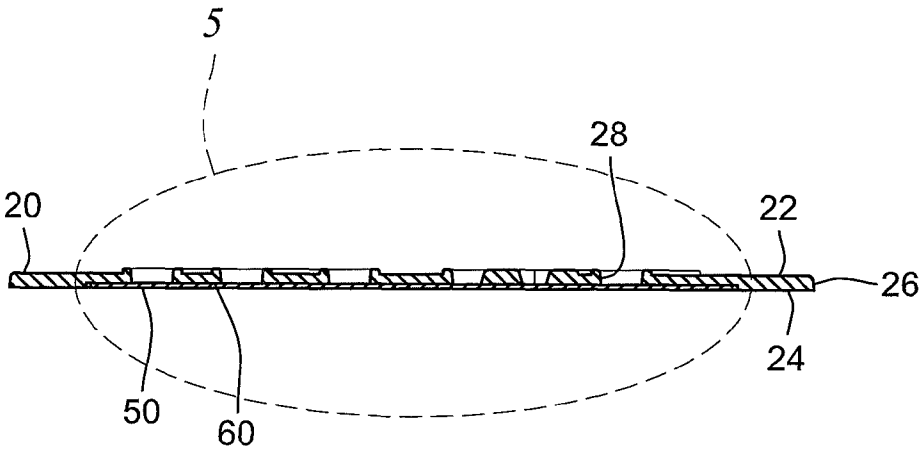
FIG. 4 shows a cross sectional view of the embodiment of FIG. 2 according to the present invention.
Figure 6:
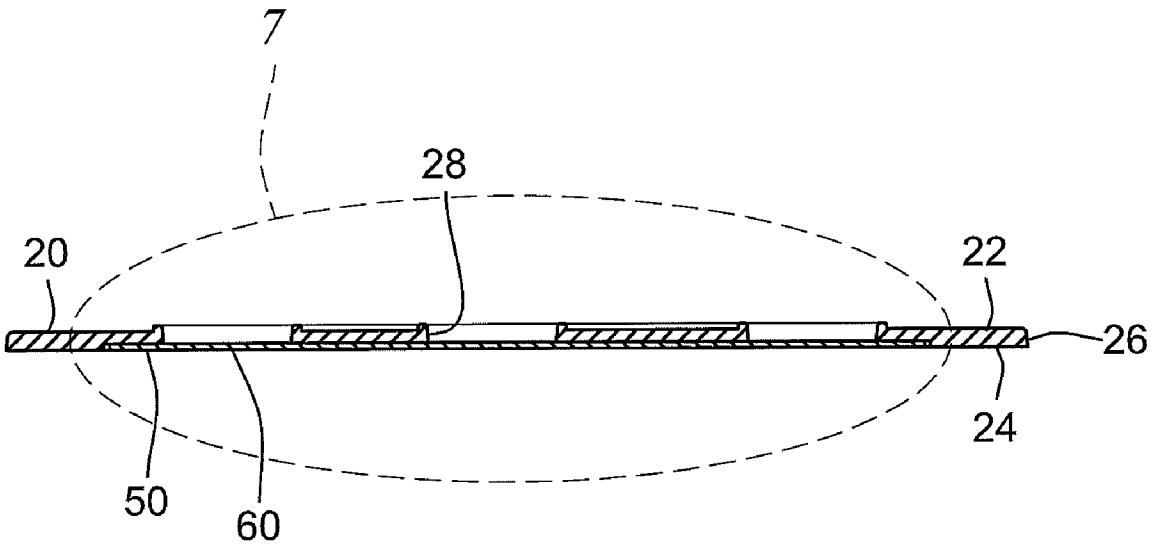
FIG. 6 shows a cross sectional view of the embodiment of FIG. 3 according to the present invention.

FIG. 4 shows a cross sectional view of the embodiment of FIG. 2 and FIG. 5 shows a partial magnified view of the cross sectional view shown in FIG. 4 according to the present invention. FIG. 6 shows a cross sectional view of the embodiment of FIG. 3 and FIG. 7 shows a partial magnified view of the cross sectional view shown in FIG. 6 according to the present invention.

As shown in FIG. 4, FIG. 5, FIG. 6, and FIG. 7, the safety kick plate device 10 includes the base component 20, the light emission component 50 and the connection component 60. The front surface 22, back surface 24, and outside edge 26 and one or more inside edges 28 of the base component 20 are shown. The cavity element 30 is positioned on the back surface 24 of the base component 20.

The light emission component 50 is received within the cavity element 30 such that the top face 52 substantially abuts the recessed surface 34. The boundary element 32 of the cavity element 30 positions the border element 56 of the light emission component 50.

The one or more inside edges 28 of the base component 20 forms a communication element 40. The communication protection element 45 includes an inward side 46, upper side 47 and outward side 48. The inward side 46 of the communication protection element 45 substantially abuts and extends from the one or more inside edges 28 of the base component 20. The inward side 46 of the communication protection element 45 continues to the upper side 47 and to the outward side 48, wherein the outward side 48 meets the front surface 22 of the base component 20.

The communication protection element 45 provides reinforcement and strength to the communication element 40. The communication protection element 45 assists to alleviate breaking or cracking of the base component 20 upon contact particularly at narrow cross-sectional areas, for example, inadvertent contact by a shoe. Additionally, the communication protection element 45 mitigates damage to the light emission component 50. The communication protection element 45 provides an elevated surface protecting the communication element 40 so that any contact near the light emission component 50 is first received by the communication protection element 45 and thereby redirected to the front surface 22 of the base component 20.

The connection component 60 joins the base component 20 and the light emission component 50. More specifically, the first securement side 62 of the connection component 60 is positioned on the bottom face 54 of the light emission component 50 and the back surface 24 of the base component 20 thereby joining the base component 20 and light emission component 50. The second securement side 64 secures the safety kick plate device 10 onto an architectural structure. In the embodiment shown, the connection component 60 is a pressure sensitive adhesive substance with attachment strength sufficient to join the base component 20 and the light emission component 50 as well as to hold the safety kick plate device 10 onto an architectural structure.

Figure 8:
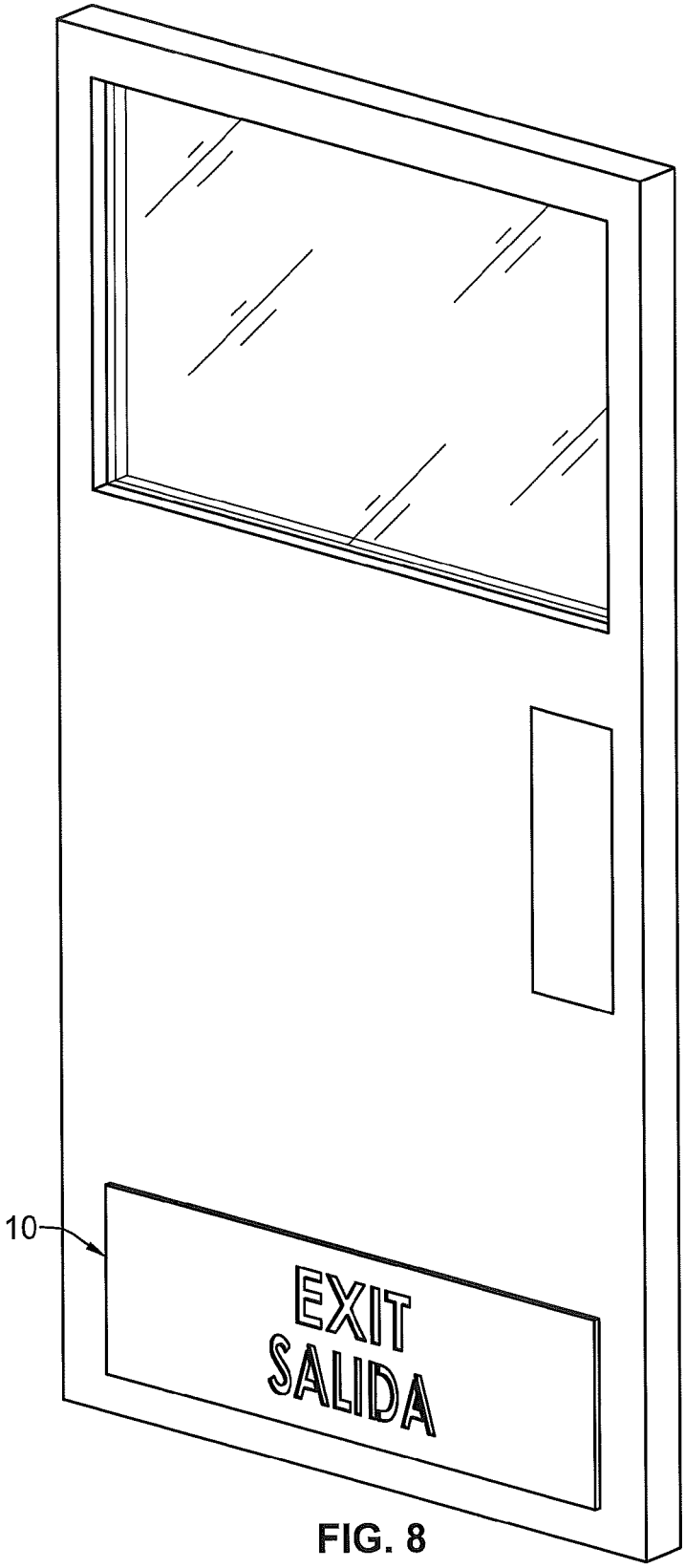
FIG. 8 shows one embodiment according to the present invention affixed to risers of stairs.
Figure 9:
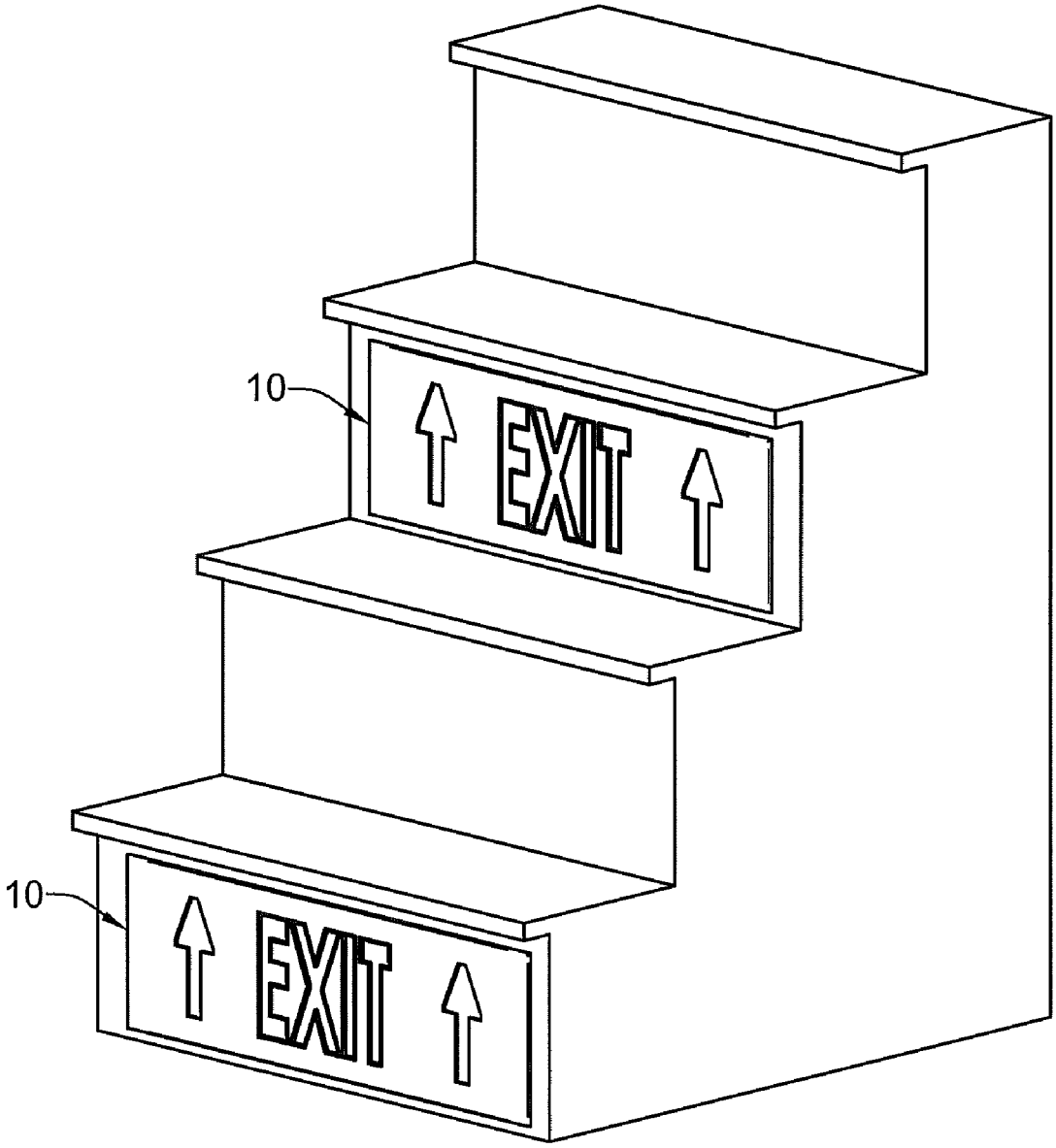
FIG. 9 shows one embodiment according to the present invention affixed to a door.

FIG. 8 and FIG. 9 illustrate the safety kick plate device according to the present invention affixed to a stair risers and a door, respectively.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. A safety device, comprising:

a base component comprising a front surface, back surface, outside edge, and one or more inside edges;

said one or more inside edges forming a communication element;

a communication protection element protruding from said front surface of said base component, wherein said communication protection element is positioned at the perimeter of said communication element and includes an inward side, an upper side and an outward side, said inward side substantially abutting and extending from said one or more inside edges of said base component such that said inward side extends from said one or more inside edges of said base component and continues to said upper side that continues to said outward side, said outward side terminates at said front surface of said base component;

a cavity element positioned on said back surface of said base component wherein said cavity element comprises a boundary element defining a recessed surface;

a light emission component comprising a top face, bottom face, and border element wherein said light emission component is received by said cavity element such that said top face of said light emission component substantially abuts said recessed surface of said cavity element, said light emission component visible through said communication element; and a connection component that joins said base component and said light emission component.

2. The safety device according to claim 1, wherein said base component is fabricated from a recycled nylon material.

3. The safety device according to claim 1, wherein said base component is fabricated from a nylon alloy material.

4. The safety device according to claim 1, wherein said communication element is "EXIT".

5. The safety device according to claim 1, wherein said communication element is "EXIT" in a foreign language.

6. The safety device according to claim 1, wherein said connection component is double sided adhesive.

7. The safety device according to claim 1, wherein said connection component is a weld.

8. The safety device according to claim 1, wherein said light emission component is strontium oxide.

9. The safety device according to claim 1, wherein said front surface includes a texture element.

* * * * *